US006988528B2

(12) United States Patent
Metz et al.

(10) Patent No.: US 6,988,528 B2
(45) Date of Patent: Jan. 24, 2006

(54) OVERHEAD DOOR ASSEMBLY

(76) Inventors: Donald Metz, c/o DL Manufacturing, 6462 Ridings Rd., Syracuse, NY (US) 13206; Dave Martini, 6943 Shannon Way, Liverpool, NY (US) 13088

( * ) Notice: Subject to any disclaimer, the term of this patent is extended or adjusted under 35 U.S.C. 154(b) by 196 days.

(21) Appl. No.: 10/687,691

(22) Filed: Oct. 20, 2003

(65) Prior Publication Data

US 2004/0144503 A1 Jul. 29, 2004

Related U.S. Application Data

(60) Provisional application No. 60/442,909, filed on Jan. 28, 2003.

(51) Int. Cl.
*E05D 15/24* (2006.01)

(52) U.S. Cl. ..... 160/201; 49/403

(58) Field of Classification Search ..... 160/201, 160/189, 190, 40, 41, 236, 235; 49/489.1, 49/495.1, 475.1, 403
See application file for complete search history.

(56) References Cited

U.S. PATENT DOCUMENTS

| | | | | | |
|---|---|---|---|---|---|
| 3,489,200 | A | * | 1/1970 | Recchione | 160/133 |
| 4,643,239 | A | * | 2/1987 | Wentzel | 160/201 |
| 4,685,266 | A | * | 8/1987 | Mullet | 52/309.11 |
| 4,887,658 | A | * | 12/1989 | Cloutier | 160/190 |
| 5,219,015 | A | * | 6/1993 | Kraeutler | 160/271 |
| 5,558,147 | A | * | 9/1996 | Nofziger | 160/190 |
| 5,718,276 | A | * | 2/1998 | Rekret | 160/201 |
| 5,829,504 | A | * | 11/1998 | Ekstrand et al. | 160/201 |
| 6,041,844 | A | * | 3/2000 | Kellogg et al. | 160/201 |
| 6,098,696 | A | * | 8/2000 | Styra | 160/201 |
| 6,679,310 | B2 | * | 1/2004 | De Zen | 160/229.1 |

* cited by examiner

*Primary Examiner*—Blair M. Johnson
(74) *Attorney, Agent, or Firm*—Sughrue Mion, PLLC

(57) ABSTRACT

An overhead door assembly as comprised of a plurality of door panels each of which is of hollow extruded plastic material to provide a very light weight panel. The panels are pivotally interconnected with each other and are provided with brush assemblies at opposite ends for engagement with a vertically extending track. Upon impact of the door panels by a vehicle of any type the brushes will disengage from the panel to prevent undue damage to the door panels.

7 Claims, 7 Drawing Sheets

OVERHEAD DOOR ASSEMBLY

This application claims benefit to U.S. Provisional application No. 60/442,909 filed Jan. 28, 2003.

BACKGROUND OF THE INVENTION

The present invention is directed to an overhead door assembly and more specifically to an overhead door assembly comprised of light weight insulated plastic panels having inter-fitting complementary top and bottom connecting portions extending the entire length of the panel. Moulded end caps are secured to opposite ends of each panel and include plastic brush material extending outwardly therefrom for sliding engagement in vertically extending tracks secured to opposite door jambs The overhead door assembly according to the present invention is designed primarily for loading dock doors which are frequently subjected to collisions with forklift trucks or loads carried by fork lift trucks operating within the warehouse. For years the common thought has been that the best way to prevent damage to the overhead door panels is to make them thicker and stronger, sometimes including metal reinforcement plates or bars to make the doors more resistant to damage. However the increased weight necessitated the need for much larger and more powerful counter balance systems to raise the doors. Thus the overall expense of manufacturing and maintaining overhead doors has risen substantially over the years.

SUMMARY OF THE INVENTION

The present invention provides a new and improved overhead door construction comprising a plurality of interlocking elongated panels of insulated plastic material. A brush assembly is secured to each end of the panel and extends the entire height of the panel. The brush assembly fits within a channel of a track member mounted on the door frame so that the panels will become disengaged from the track should they be severely impacted by a forklift truck or the like. Thus the individual door panels remain substantially undamaged by the impact and can be easily reassembled with the brushes in the opposed tracks. In view of the extremely light weight construction of the overhead door only a small counterweight is necessary and can be guided in a bore extending the length of the track member. The counterweight is connected to the top of the door by a strap trained over a self aligning pulley. The door construction is so light that the overhead door can be raised and lowered by hand or by a small electric motor. Due to its light weight, the amount of energy that is transferred from impact is minimized, thus greatly reducing damage. Suitable weather seals are provided along the length of the top and bottom panels and the density of the brush materials enables the brushes to act as a weather seal along the opposite sides of the door.

The specific nature of the invention, as well as advantages thereof, will clearly appear form the following description and from the accompanying drawings.

DETAILED DESCRIPTION OF THE INVENTION

Figure 1:
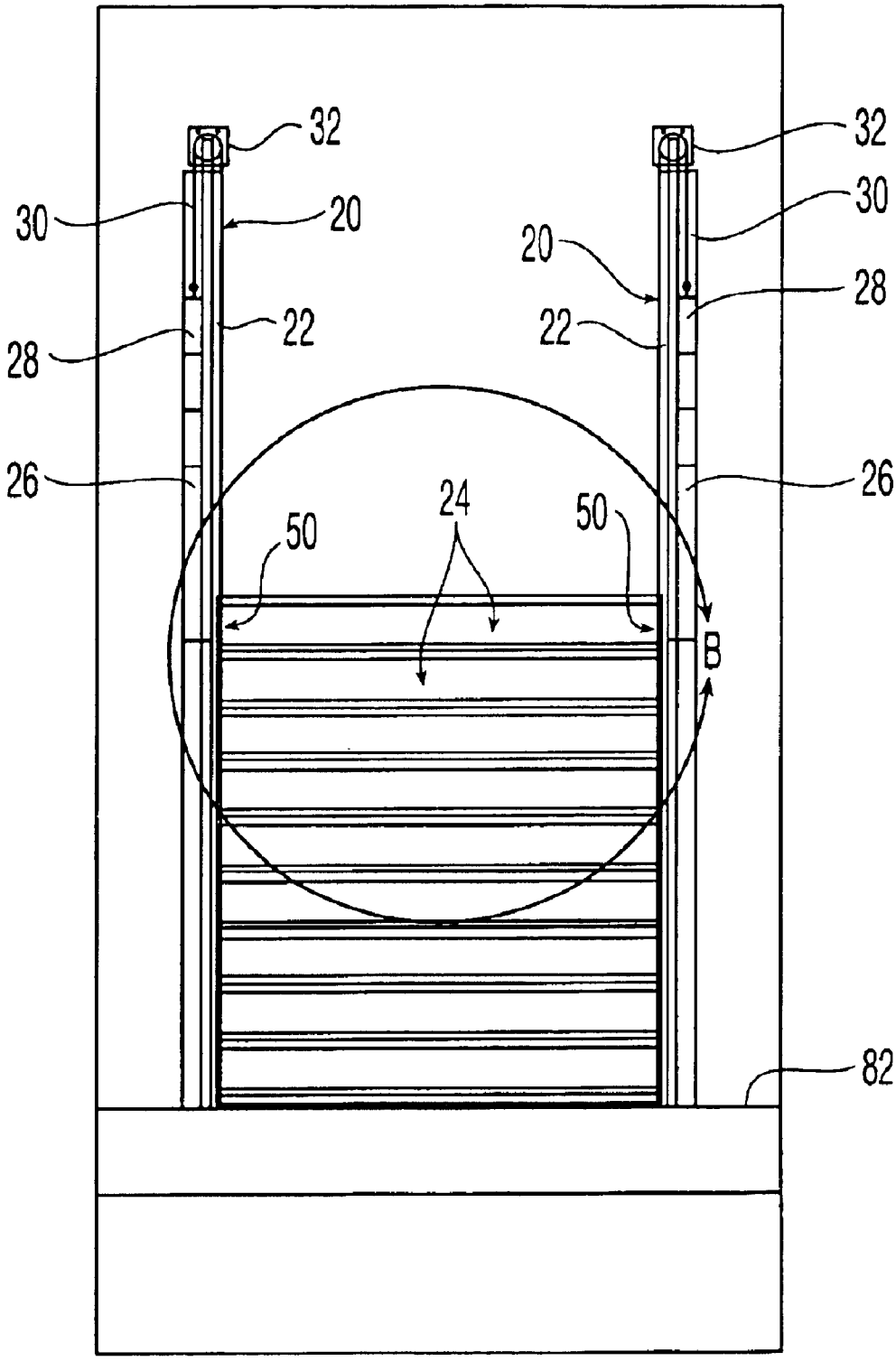
FIG. 1 is an inside view of an overhead door assembly.
Figure 2:
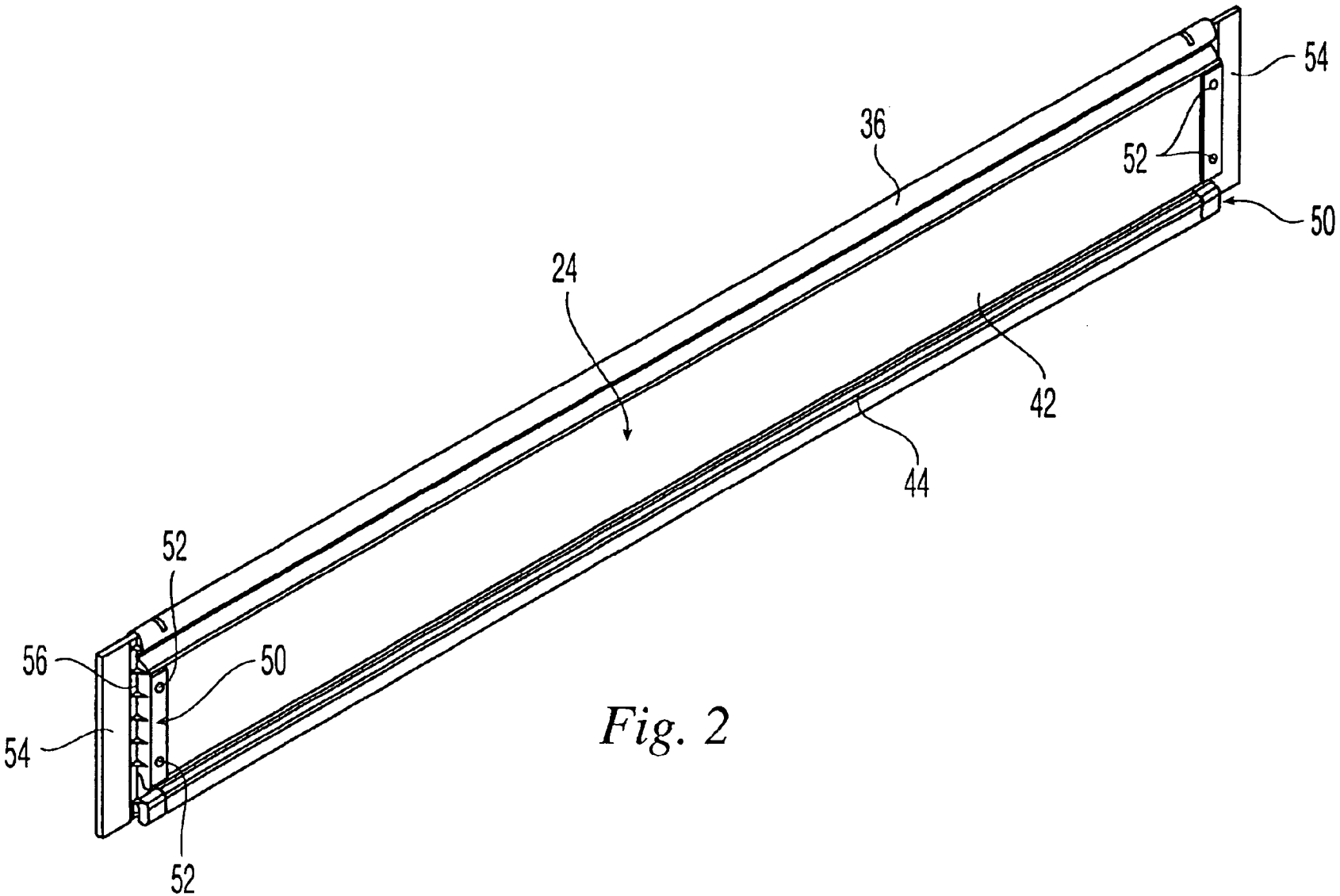
FIG. 2 is a perspective view of the inside of an overhead door panel with brush holding end caps attached thereto.

FIG. 1 is an inside view of an overhead door assembly according to the present invention. A pair of parallel track members 20 are mounted on an interior wall of a structure on opposite sides of a door opening which is not visible in FIG. 1 since the door is in the closed position relative to the door opening. Each track member 20 is provided with a channel 22 which is open and facing the other channel for the reception of a brush, not shown, mounted on opposite ends of each door panel 24. Each track member 20 is further provided with a counterweight passage 26 for reception of a counterweight assembly 28 connected to the uppermost door panel 24 by means of a strap or cable 30 which extends over a pulley 32.

Figure 3:
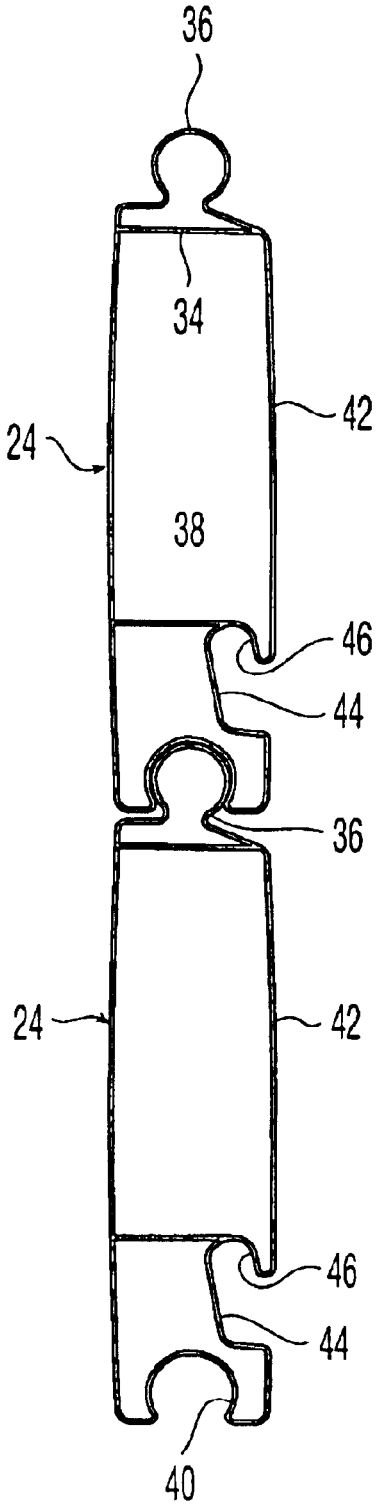
FIG. 3 is an end view of two interconnected door panels without the end caps.

Each door panel 24 as shown in FIG. 3 is comprised of a hollow, light weight extruded plastic member having integral reinforcement panels 34 and 38 to maintain shape of each panel. Each panel is provided with an elongated rounded top portion 36 and a complementary rounded recess 40 along the bottom edge of the panel. Due to the complementary shape of the top projection 36 and the bottom recess 40, adjacent panels can be rotatably connected relative to each other only by longitudinal insertion of the rounded portion 36 into the rounded recess 40 as best seen in FIG. 3. The interior surface 42 of each panel 24 has an integrally moulded recess 44 adjacent the lower edge which defines a finger gripping portion 46 for raising and lowering the overhead door assembly.

Each door panel is flexible and will bend in a direction transverse to the length of the panel to absorb impacts and prevent damage to the panel. If the force of the blow is large enough the rounded portion 36 will separate from the recess 44 to limit any damage to the panel. The panels will return to their original shape and can be reassembled as mentioned above.

Each door panel 24 is provided with end caps 50 which are secured to opposite ends by means of rivets 52 or any other suitable means. Each end cap has a brush 54 comprised of a plurality of relatively stiff bristles secured in a channel 56 by an adhesive or any other suitable means.

Figure 4:
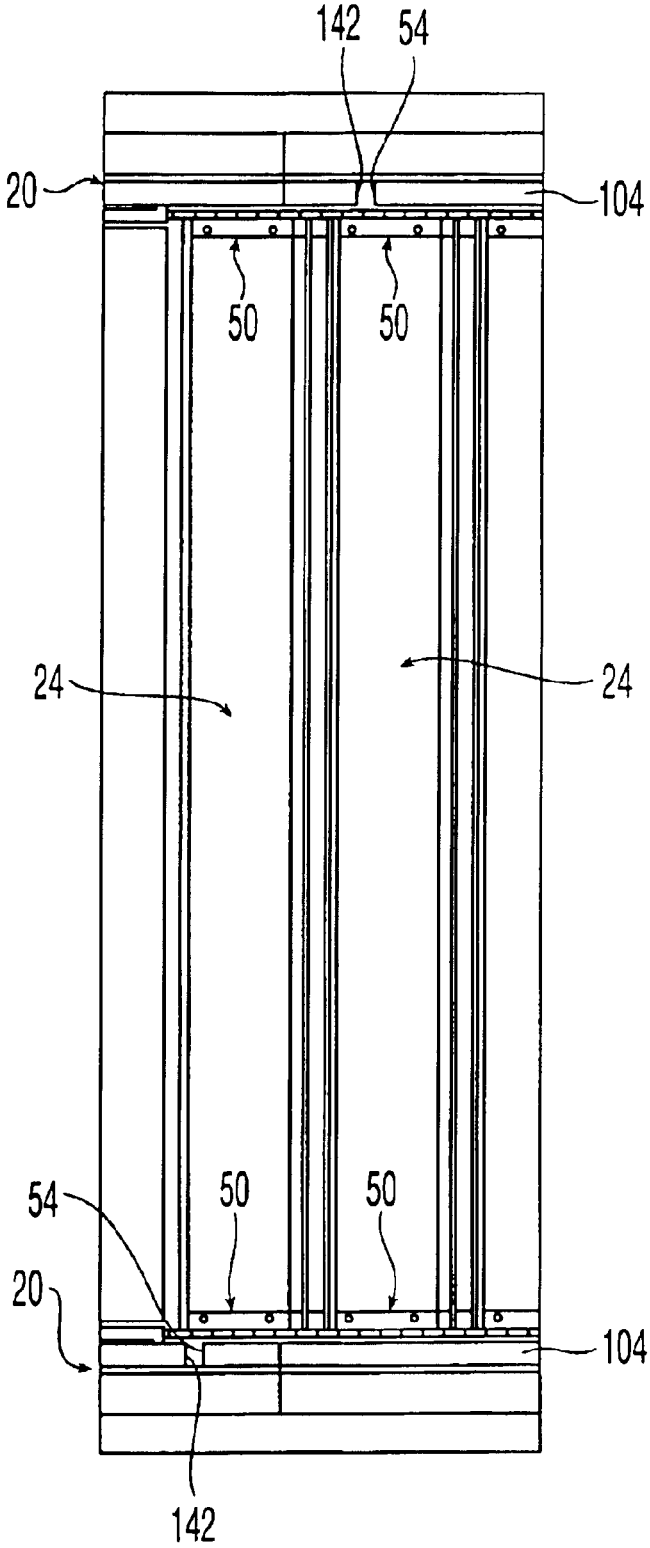
FIG. 4 is an enlarged detail of the area designated by a circle B in FIG. 1.
Figure 5:
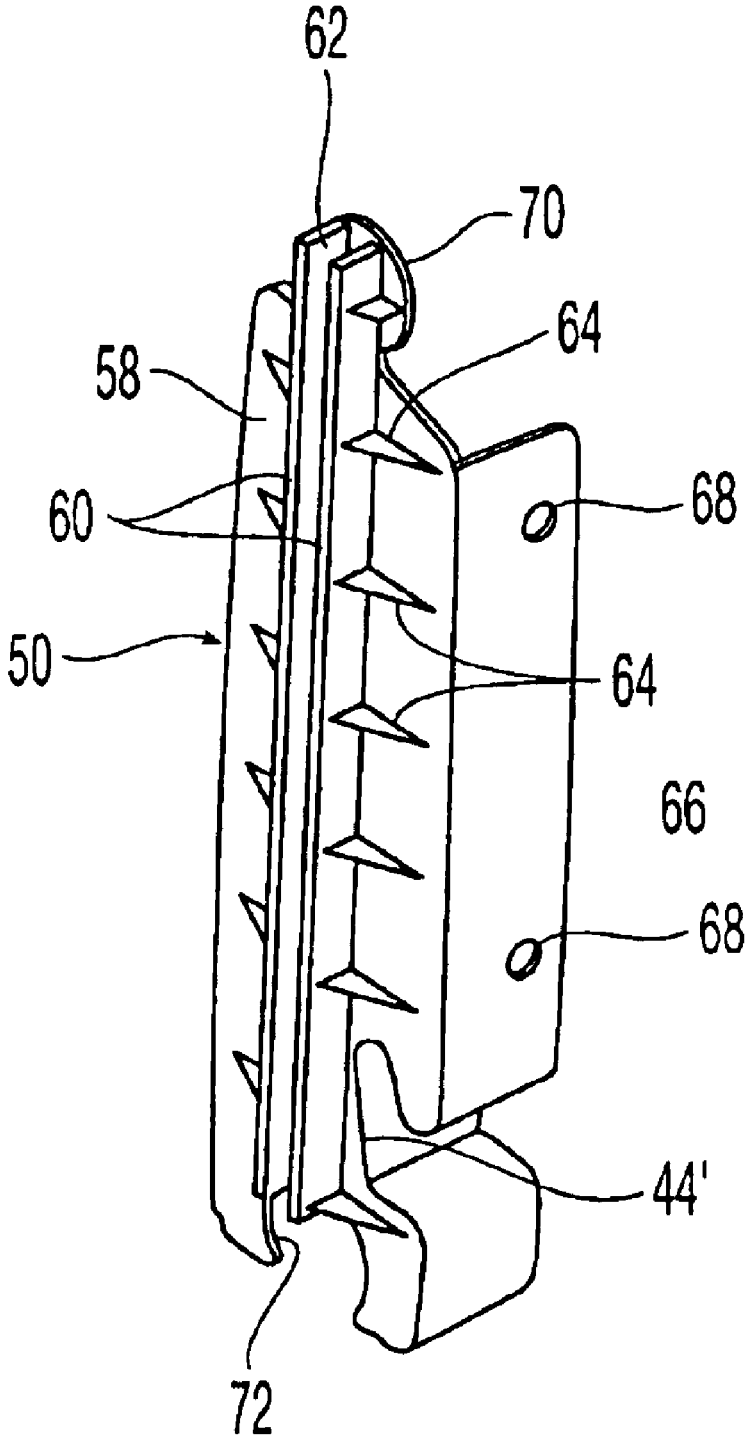
FIG. 5 is a perspective view of an end cap without the brush.

An end cap 50 without the brush is shown in FIG. 5. The end cap is provided with an end plate 58 having a shape which is complementary to the hollow interior of a door panel for closing the hollow interior when the end cap is secured to the end of the door panel. A pair of spaced apart elongate walls 60 are secured to the end surface 58 by welding or the like to define a channel 62 for the reception of a brush 54. A plurality of reinforcing plates 64 are connected to the walls 60 and the end surface 58 to stabilize the walls 60. A pair of parallel flanges are provided along opposite sides of the main panel 58 and have holes 68 for the reception of rivets or the like to connect the end cap 50 to the end of a door panel. The end cap 50 is also provided with a recess 44' complimentary to the recess 44 in the door panel. The end cap is also provided with a rounded top portion 70 and a complimentary rounded recess 72 at opposite ends of the end cap which are complimentary to the projection 36 and the recess 40 on each panel. FIG. 4 is an enlarged view showing the door panels 24 with the end caps 50 mounted thereon with brushes 54 disposed within the channels on the end caps. The brushes 54 are disposed within the channel of each track member 20.

Figure 6:
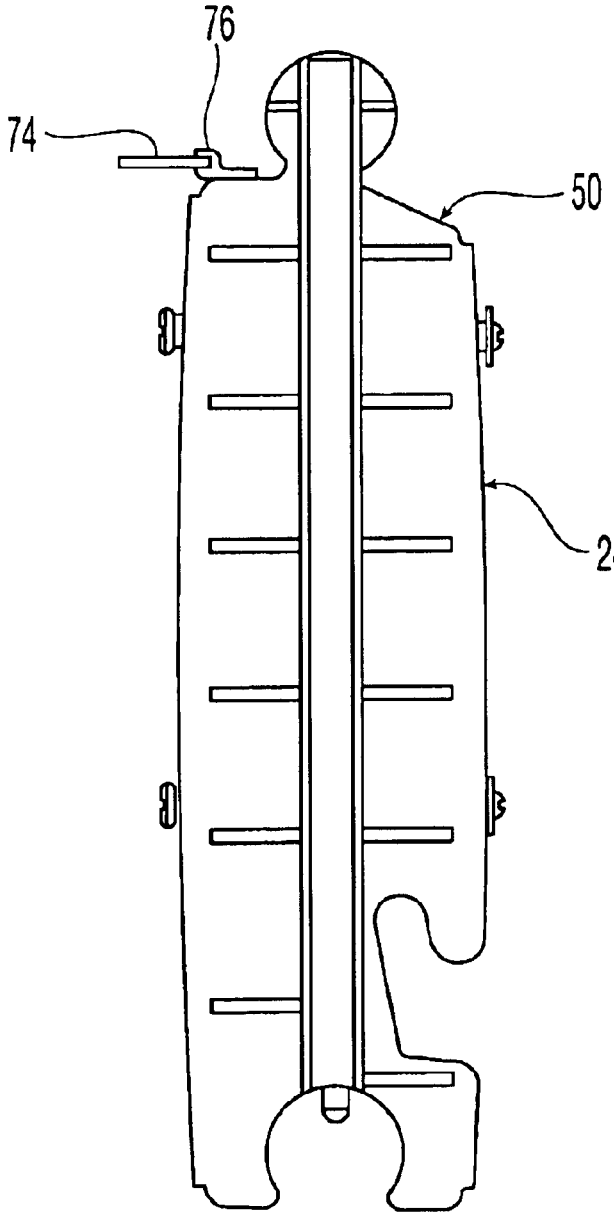
FIG. 6 is an end view of an end cap for the uppermost door panel of an overhead door assembly with one end of a weather strip mounted thereon for engagement with a door frame.
Figure 7:
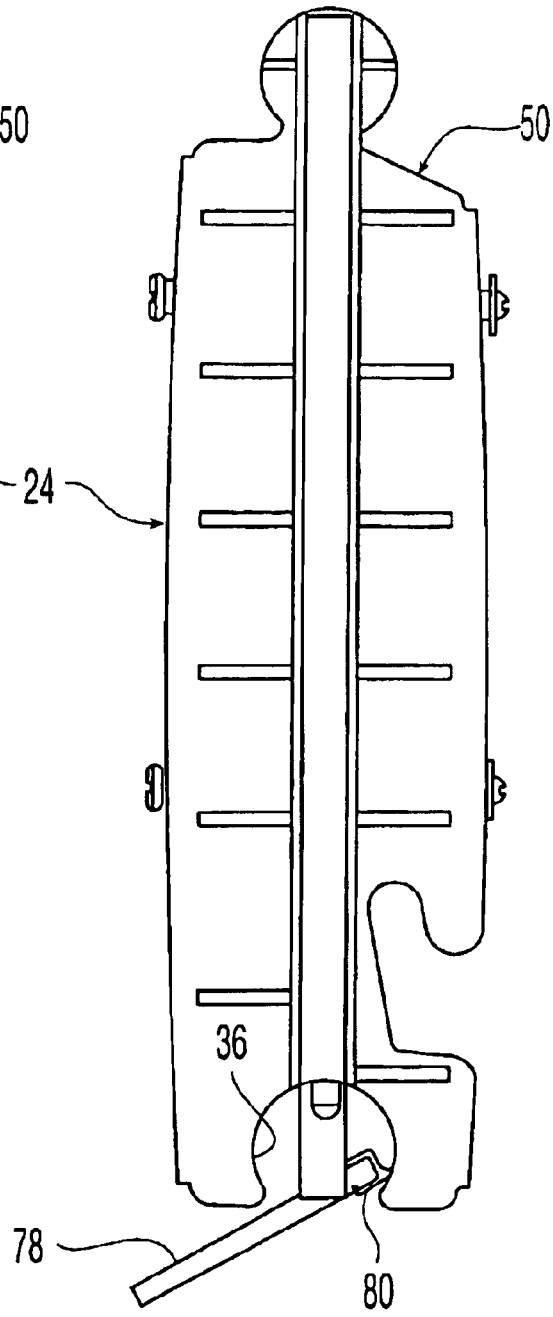
FIG. 7 is an end view of a door cap for a lowermost door panel with one end of a weather strip secured thereto for engagement with the floor of a structure.

FIG. 6 is an end view of the top most door panel 24 of a door assembly. An elongated piece of weather stripping 74 is mounted in a bracket 76 which in turn is secured to an upper surface of the door panel by any suitable means such as rivets or the like. The weather stripping 74 extends the entire length of the door panel and is adapted to engage the interior surface of a door frame, not shown, when the overhead door assembly is in the closed position. FIG. 7 is an end view of the lowermost door panel 24 of an overhead door assembly. An elongated piece of weather stripping 78 is secured in a bracket 80 which is secured in the rounded recess 36 of the lowermost door panel by any suitable means. Thus, the weather stripping 78 will extend the entire length of the lowermost door panel for engagement with the floor 82 of the structure as shown in FIG. 1. The piece of weather stripping 74 or 78 may be a piece of flexible material such as rubber of a brush assembly.

Figure 8:
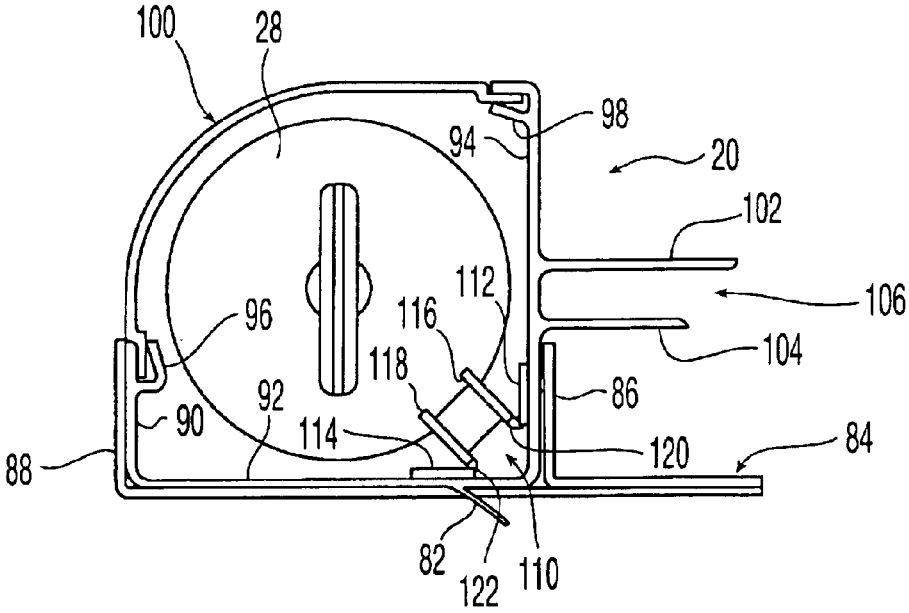
FIG. 8 is a top plan view of a track member with a channel for receiving a brush assembly on a door panel and a counterweight passage with a counterweight disposed adjacent a magnet assembly.
Figure 9:
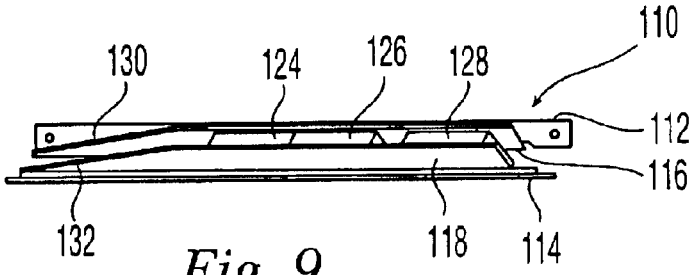
FIG. 9 is a perspective view of the magnet assembly per se.
Figure 10:
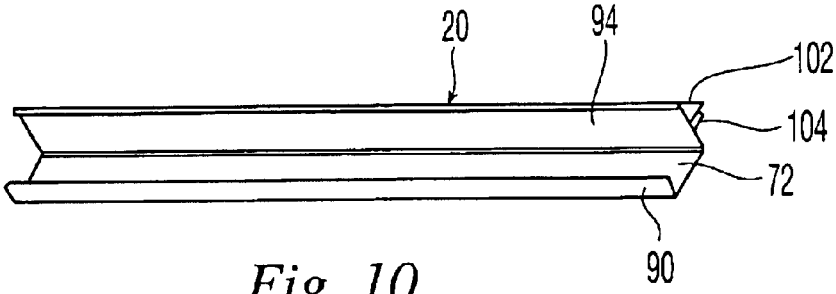
FIG. 10 is a perspective view of a side track member with the counterweight passage cover removed.
Figure 11:
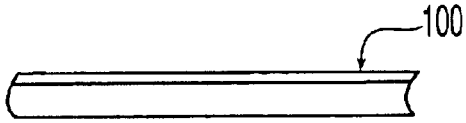
FIG. 11 is a perspective view of the counterweight passage cover per se.

FIG. 8 is a top plan view of a track assembly 20 as shown in FIG. 1. The track member 20 is adapted to be mounted on an interior surface of a door frame, not shown, by means of a bracket 84 comprised of two L-shaped members 86 and 88 which are connected to each other by welding, fasteners or the like. The members 86 and 88 are extruded vinyl material and extend the entire length of the door opening. The member 88 which is to be mounted on a wall or a door frame is provided with a co-extruded piece of a vinyl weather stripping 87 extending the entire length of the member 88. The track members 20 are each comprised of a main channel having three walls 90, 92 and 94 formed of one piece of metal material and disposed at right angles to each other as shown in FIG. 8. The free ends of the walls 90 and 94 are provided with protrusions 96 and 98, respectively, which define a channel for the reception of opposite edges of a curved channel cover 100. A perspective of the track 20, per se, without the cover 100 is shown in FIG. 10 and a perspective view of the cover 100 is shown in FIG. 11.

A pair of parallel walls 102 and 104 protrude from the side wall 94 to define a channel 106 extending the length of the track member for the reception of the brushes 54. As shown in FIG. 8, a counterweight 28 is movable up and down the channel in the track 20 by means of the cable 22 connected to the overhead door. A magnet assembly 110 is mounted in the channel adjacent the top thereof so that the counterweight will be disposed adjacent the magnetic assembly when the overhead door is in the closed position as shown in FIG. 1. The magnet assembly 110 is comprised of a pair of mounting plates 112 and 114 mounted on the walls 94 and 92, respectively of the channel, by any suitable means such as rivets or welding. A pair of parallel spaced apart plates 116 and 118 are connected to the mounting plates 112 and 114, respectively, by hinge member 120 and 122. A plurality of magnets 124, 126 and 128 are mounted between the two plates 116 and 118 by any suitable means such as an adhesive or the like. The lower edges of the plates 116 and 118 are beveled at 130 and 132, respectively, so that when the counterweight 28 approaches the magnet assembly it will engage the beveled surfaces 130 and 132 and move to one side of the channel so that it can move into aligned relationship with the magnets 124, 126 and 128 without damaging the magnet assembly 110. The magnets should be mounted in the magnet assembly with opposite poles adjacent to each other and the counterweight should be of magnetic material. The attractive force of the magnets will tend to hold the counterweight in the raised position thereby effectively reducing the weight of the counterweight which would tend to open the door in an undesirable manner. When the door is positively moved to an open position manually or otherwise the weight of the counterweight will be sufficient to overcome the magnetic force and the counterweight will descend within the channel to assist in the raising of the overhead door.

Figure 12:
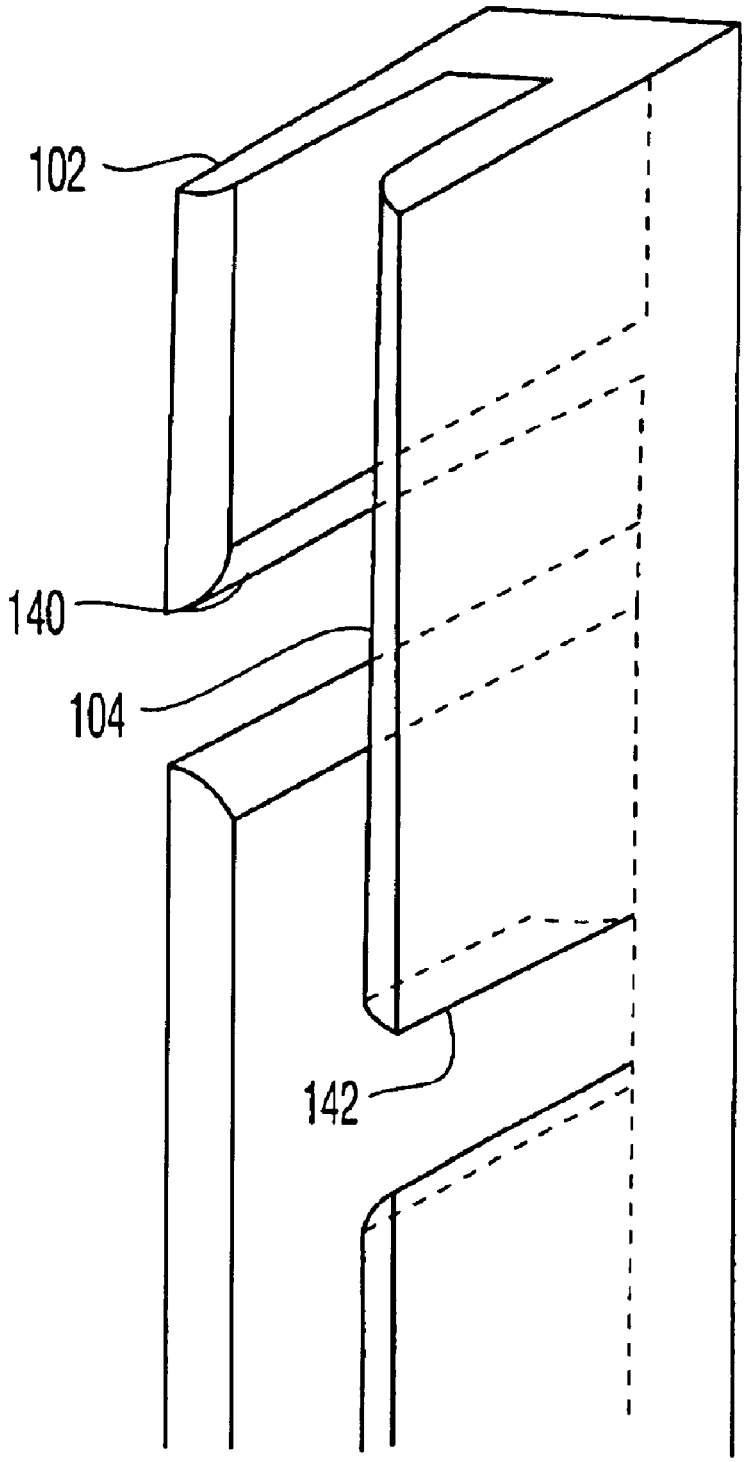
FIG. 12 is a perspective view of a portion of the side track member showing the passages for reintroduction of the brush material of a door panel.

The upper portion of the guide track for the brushes defined by the parallel plates 102 and 104 is shown in FIG. 12. A pair of slots 140 and 142 are provided in the outside plate 102 and the inside plate 104, respectively, to allow for the reinsertion of the brushes should one or more brushes on one or more door panels become disengaged from the track upon impact on the door from the inside of the door. The openings 142 in the inside panel 104 are shown in FIG. 4 in conjunction with the door panels 24 and the brushes at each end of the door panels. The brushes would not ordinarily be damaged if they are forced from the guide tracks due to an impact on the door panels. But if the brushes are damaged in any way or become worn the brushes can be readily replaced.

The overhead door assembly according to the present invention provides an extremely lightweight assembly which can be raised and lowered manually. However a small electric motor could be associated with the cable for the automatic raising and lowering of the overhead door assembly upon operation of a switch. The panels can be filled with a light weight insulating material if desired. The provision of insulation material would not adversely affect the operation of the overhead door assembly. While the door assembly is provided with two vertically extending tracks 20 as shown in FIG. 1 in a warehouse environment where sufficient clearance would be available it is also possible to provide curved tracks similar to those in conventional overhead door assemblies for residential garages. Since the individual door panels are pivotally articulated with respect to each other the door would readily adapt to such a curved track arrangement.

While the preferred embodiment has been described, variations thereto will occur to those skilled in the art within the scope of the present invention concepts.

What is claimed is:

1. An overhead door assembly comprising a plurality of elongated door panels pivotally interconnected with each other along respective longitudinal edges of the panels, a pair of parallel guide tracks adapted to be mounted on an interior surface of a door frame and complimentary guide means mounted on opposite ends of each door panel extending into respective guide tracks for guiding the overhead door between an open position and a closed position, wherein each door panel is comprised of an elongated hollow flexible extruded plastic panel having an integral protrusion and recess along respective top and bottom edges of the door panel for pivotally interconnecting adjacent panels and wherein said guide means are comprised of a pair of end caps mounted on opposite ends of each door panels and having outwardly extending brush assemblies connected thereto and extending into said guide tracks to guide said overhead door upwardly and downwardly while allowing disengagement of the brush assemblies from the guide tracks upon application of an impact force against one or more door panels.

2. An overhead door assembly as set forth in claim 1 wherein said end caps are each comprised of a plate having parallel flanges extending therefrom and connected to said door panels and a pair of parallel panels extending from said plate in a direction opposite to said flanges to define a vertically extending slot in which said brush assemblies are mounted.

3. An overhead door assembly as set forth in claim 1 wherein at least one of said guide tracks is comprised of an elongated hollow channel member having a pair of parallel spaced-apart flanges extending laterally outwardly therefrom for receiving said brush assemblies and a counterweight connected to a door panel of said door assembly by means of the cable extending about a pulley mounted adjacent and upper end of at least one of said guide tracks wherein said counterweight is movable disposed in said channel member.

4. An overhead door assembly as set forth in claim 3 wherein said counterweight is comprised of magnetic material and further comprising a magnet assembly mounted in said channel member adjacent an upper end thereof to magnetically attract said counterweight of magnetic material when said counterweight moves upwardly to a position adjacent said magnet assembly to effectively reduce the weight of the counterweight.

5. An overhead door assembly as set forth in claim 1 wherein said guide tracks are provided with slots to enable reengagement of said brush assemblies in said guide tracks.

6. An overhead door assembly as set forth in claim 1 further comprising an elongated weather strip secured the uppermost door panel of said overhead door assembly for engagement with an uppermost surface of a door frame.

7. An overhead door assembly as set forth in claim 1 further comprising an elongated weather strip secured to a lowermost door panel wherein said elongated weather strip extends outwardly of the elongated recess extending along the bottom edge of the lowermost door panel for engagement with a floor.

* * * * *